United States Patent [19]

Shima et al.

[11] 4,442,683

[45] Apr. 17, 1984

[54] STITCH PRESSING DEVICE FOR FLAT KNITTING MACHINE

[75] Inventors: Masahiro Shima; Hirotsugu Nishida, both of Wakayama, Japan

[73] Assignee: Shima Idea Center Co., Ltd., Wakayama, Japan

[21] Appl. No.: 367,407

[22] Filed: Apr. 12, 1982

[30] Foreign Application Priority Data

Apr. 28, 1981 [JP] Japan ..... 56-64490

[51] Int. Cl.[3] ..... D04B 7/04

[52] U.S. Cl. ..... 66/64

[58] Field of Search ..... 66/64, 60, 60 H

[56] References Cited

U.S. PATENT DOCUMENTS 3,153,922 10/1964 Bram ..... 66/64

3,685,317 8/1972 Giachetti et al. ..... 66/60

4,080,806 3/1978 O'Sullivan ..... 66/64

FOREIGN PATENT DOCUMENTS 54-139748 9/1979 Japan .

*Primary Examiner*—Ronald Feldbaum

[57] ABSTRACT

A stitch pressing device for flat knitting machine consists essentially of a combination of stitch pressing means and sub-presser means, both provided on a carriage. The forward end portion of a L-shaped stitch presser bar operative at same phase as a knitting lock on the carriage is adapted to enter into and retract from a gap between a pair of needle beds through movement involving a circular motion above a knockover comb. A sub-presser element which operates at a different phase from that of the stitch presser bar has its front portion constantly positioned in the gap between the needle beds and is urged downwardly deeper into the gap than the presser bar. A brush provided at substantially same phase as the horizontal portion of the stitch presser bar is adapted to retract from its operative position relative to needles in synchronism with the early phase of retraction of the presser bar so as for it not to damage the hair ends of the brush during such retracting movement.

11 Claims, 21 Drawing Figures

FIG. 9 - A
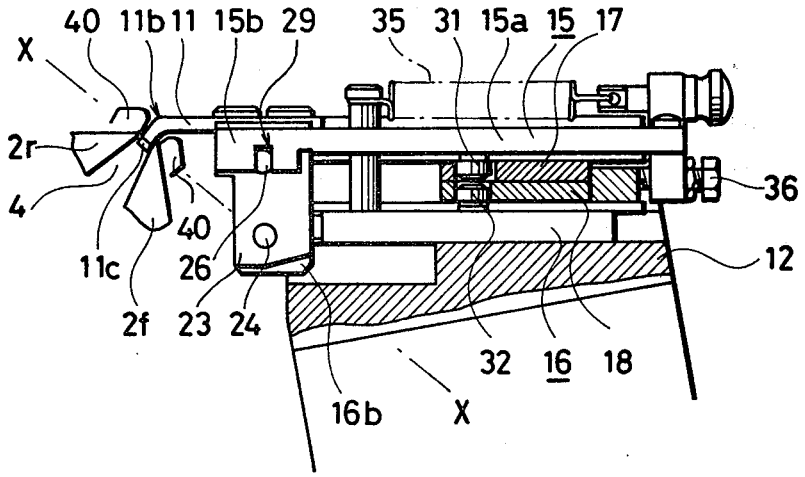
FIG. 9 - B
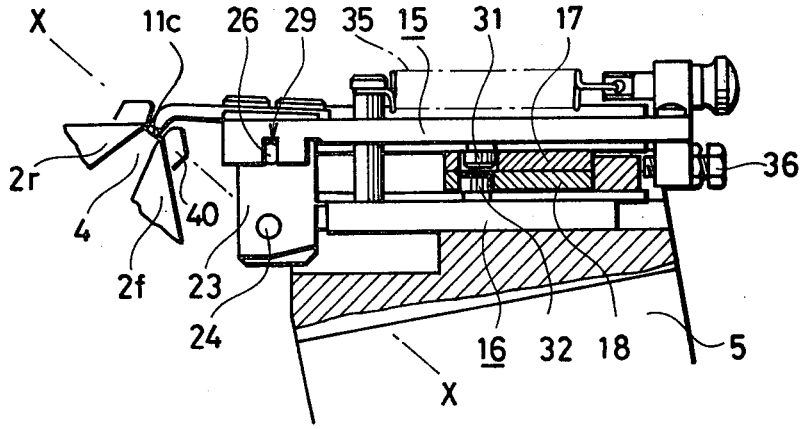

FIG. 9 - C
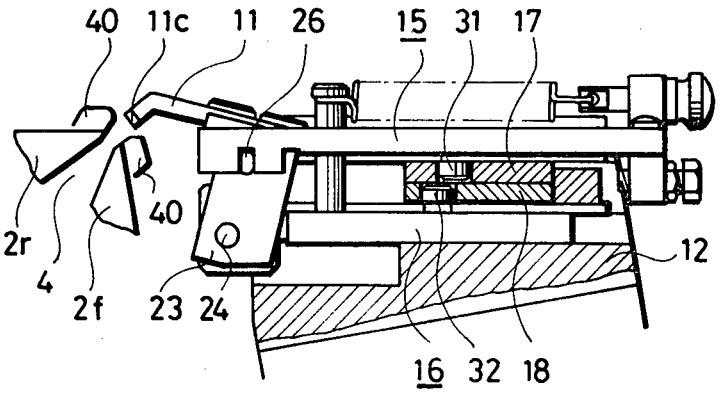
FIG. 9 - D
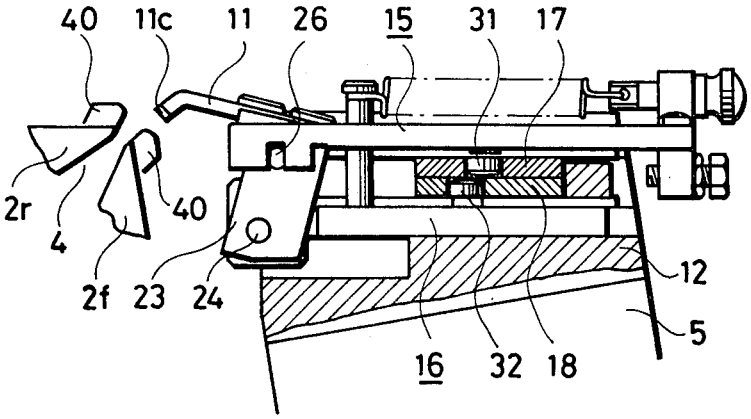

FIG. 9 - E
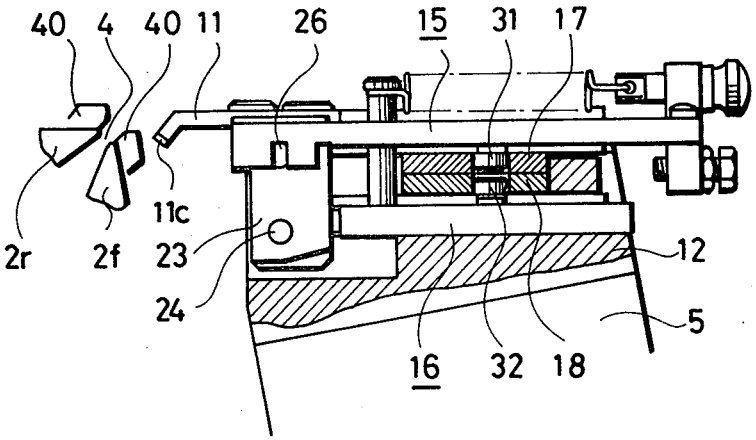
FIG. 9 - F
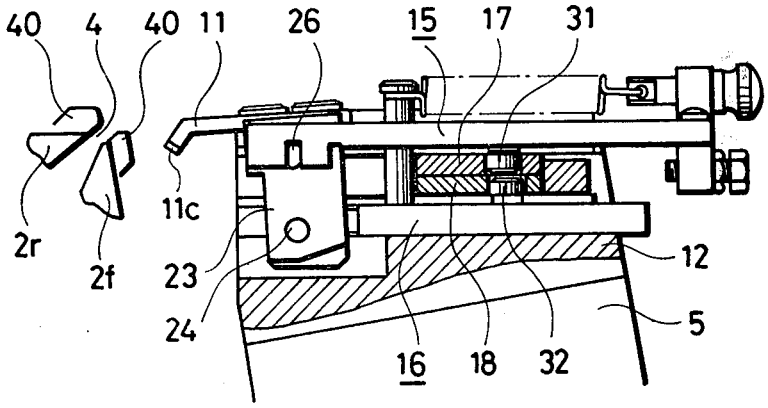

STITCH PRESSING DEVICE FOR FLAT KNITTING MACHINE

BACKGROUND AND SUMMARY OF THE INVENTION

The present invention relates to a stitch pressing device for flat V-bed knitting machine. More particularly, it relates to a stitch pressing device provided in a flat V-bed knitting machine of the type having a pair of needle beds arranged in an inverted-V pattern with a gap formed therebetween so as to permit the needles of the needle beds to cross each other in the course of their upward movement and having a carriage reciprocably movably arranged above the needle beds and comprising a pair of cam boxes integrally connected to each other, each cam box being provided with knitting cams which act on the needles during knitting operation, wherein the stitch pressing device permits the formed stitches to descend from a knockover comb without weights or a take-down mechanism being provided below the gap between the needle beds to pull the stitches downward.

Various stitch pressing devices are known which are designed to perform such function. They may be broadly classified into two types. One type is of V-shape when viewed in front elevation. It is generally such that on the carriage there are provided a pair of lateral members bridging the two cam boxes, front and rear, of the carriage, a support member spanning the lateral members, and arms swingable along the length of the needle beds and supported on the support member, and a V-shaped stitch pressing device is attached at the middle portion thereof to the lower end of each arm. In a flat knitting machine employing a stitch presser of this type, the arm is caused to swing at the point of reversal of the movement of the carriage so that the left half part of the V-shaped stitch presser is brought in sliding contact with the stitches being formed during the rightward travel of the carriage and the right half part of the stitch presser is brought into slide contact with the stitches during the leftward travel of the carriage, thus stitch pressing is effected throughout the movement of the carriage. Stitch pressing devices of such swingable V-shaped type are disclosed, for example, in the U.S. Pat. Ser. No. 3,839,884, U.S. Pat. Ser. No. 3,842,623, and U.S. Pat. Ser. No. 4,027,504.

The other type is such that the stitch presser comprises a pair of L-shaped single-way stitch pressing means, one provided on one of the cam boxes and adapted to enter into the gap between the needle beds for sliding contact with the knitted fabric during the movement of the carriage in one direction only and the other provided on the other cam box and adapted to enter into the gap for sliding contact with the knitted fabric during the movement of the carriage in the opposite direction. Coming within the category of this type is, for example, one previously developed by the present inventor (which is disclosed in the specification of Published unexamined Japanese Utility Model Application No. 54-139748).

These known stitch pressers have their disadvantages as well as advantages, as pointed out below.

The V-shaped stitch presser swingable for change-over movement as disclosed in U.S. Pat. Ser. No. 3,842,623, for example, has an advantage that it does not require overrun of the carriage beyond the length of needle bed in order to allow swinging of the stitch presser.

In order that it may be held in operative position, however, the V-shaped stitch presser is provided with a pair of lateral members bridging the front and rear cam boxes, a support extending between the lateral members, and arms swingably carried by the support; these elements move back and forth in synchronism with the carriage, occupying the space above the clearance between the needle beds. In a flat knitting machine to which this type of stitch presser is applied, therefore, it is necessary that the space above and over the full length of the gap between the needle beds must be open at all times for the passage of the support and the arms extending downwardly from the support.

As such, where this type of stitch presser is employed in flat knitting machines, the difficulty is that no space is available right above the gap for provision of yarn guide rails for yarn carrier means or for movement of yarn guide levers. Especially in a novelty pattern knitting machine which requires as many yarn guide levers as possible, this is very inconvenient because it limits the numbers of yarn guide rails and yarn guide levers to be provided.

Another difficulty with the known stitch pressers of V-shape type is that the non-operating side of the stitch presser during the movement of the carriage in either direction is always kept projecting diagonally upward above the gap between the needle beds and in the direction of movement of the carriage; since the stitch presser is larger in width than the arm to which it is mounted, the non-operating side of the stitch presser is liable to contact a yarn guide lever in rest position during the movement of the carriage, thus causing troubles.

The L-shape type stitch pressing device has an advantage over the V-shape type in this respect. As above mentioned, one known pressing device of this type has two L-shaped stitch pressers individually mounted on the cam boxes, one movable in its operative position during the movement of the carriage in one direction and the other movable in its operative position during the movement of the carriage in the opposite direction. The L-shaped stitch presser comprises a base portion corresponding to the upper end of vertical portion of "L", mounted on a support provided on a cam box above one of the needle beds, a portion corresponding to the vertical portion of "L", disposed in a downward facing position in substantial parallelism with the needle tricks of the other needle bed, said vertical portion being downwardly inclined toward its end, a horizontal front portion, said front portion being adapted to enter into and retract from the gap between the needle beds to take an advanced position (operative position) and a retracted position (inoperative position), said advanced position covering an area extending laterally within the gap, said retracted position being a position close to the upper-side surface of the needle bed below the cam on which the stitch presser is mounted and not in the way of needles moving upward from the opposite needle bed. In this type of stitch pressing device, the space which the pressers occupy above the needle beds is limited to a space of up to slightly above the level of knockover comb.

Unlike the V-shape presser type wherein the pressers are adapted to swing in the gap between the needle beds, therefore, the L-shape presser type has an adavantage that the open space above the gap can be fully utilized for provision of yarn-guide carrier means so that a greater number of yarn guide levers are allowed to run in the space.

In known stitch pressers of the L-shape type, however, the horizontal portion of "L", or operative portion of the presser which comes in slide contact with and exerts pressure upon the formed stitches is movable only along the needle tricks for access into and retraction from the gap between the needle beds or the space between the knockover combs thereof; therefore, the difficulty with this type is that displacement of pressers for changeover requires the overrun of the carriage beyond the length of the needle beds so that the pressers are brought to a position outside the gap between the needle beds for changeover. In other words, known stitch pressers of this type have a disadvantage that the carriage is required to reciprocate its full course of movement (longer than the length of the needle beds) irrespective of the required width of knitting.

The primary object of the present invention is to provide an improved stitch pressing device of the L-shape type which eliminates the disadvantage of known devices of the type while retaining the advantage of such known devices over the known V-shape type stitch pressers and which also has an advantageous feature similar to that of said known V-shape type pressers.

To this end, the present invention contemplates to provide a stitch pressing device of L-shape type comprising stitch pressing means arranged on the carriage and operable in synchronism with the reciprocation of the carriage and at substantially same phases as the operative zones of knitting and transfer locks disposed on the carriage, said stitch pressing means consisting of a pair, one provided on one of the cam boxes on the carriage and having a L-shaped stitch presser bar operable during the movement of the carriage in one direction in manner that its operative portion enters the gap between a pair of needle beds for slide contact with formed stitches and the other provided on the other cam box and having a L-shaped stitch presser bar operable during the movement of the carriage in the opposite direction in manner that its operable portion enters said gap for slide contact with formed stitches, individual operative portions of the pair of stitch pressing means being adapted to be given movement involving a circular motion for passage above the knockover comb so that the operative portions are controllable at a given position above the needle beds for movement between operative and non-operative positions without overrun of the carriage beyond the length of the needle beds.

By imparting to the presser bars such movement involving a circular motion, the displacement of the pair of stitch pressing means between operative and non-operative positions can be controlled at a given position above the needle beds without excessive movement of the carriage. Naturally, however, the possible depth of descent of the presser bar into the gap that may be attained by such movement involving a circular motion is limited. With the stitch pressing device as above proposed, it is impracticable to achieve deep entry into the gap of the operative portion which comes in slide contact with the knitting.

Where a pressing device of such construction is employed, the presser bar thereof may sufficiently press the uppermost row of stitches to force down the fabric being knitted if the uppermost row of stitches hangs across the gap and between needles of the needle beds (as in the case of rib stitches), but if the uppermost row is depending from needles of one needle bed only (as in the case of plain stitches), the presser bar cannot sufficiently force the fabric downward because its entry into the gap is not deep enough.

Further, it is noted that the known stitch pressers, both V-shape and L-shape types, have their operative areas relative to the knitting in substantially same zones as those of knitting locks on the carriage; therefore, the formed rows of stitches are somewhat liable to rise after the passage of the presser, so the provision of a holding-down member is required in order to prevent such rise.

Another object of the invention is to provide a stitch pressing device which has sub-presser means adapted to suitably press down the formed stitches, whether the uppermost row of stitches is hanging between needles of both needle beds or it is hanging from needles of one needle-bed only, and which has said sub-presser means disposed intermediate the individual stitch-pressing means and in the widthwise direction of the carriage so that prevention of stitch rise and holding-down of the knitting can be effectively performed without provision of hold-down means below the gap between the needle beds.

The problems as set forth above have thus been solved. Hence, the stitch pressing device in accordance with the present invention is characterized by: stitch pressing means arranged on a carriage and operable at substantially same phases as the operative zones of knitting and transfer locks on the carriage, sub-presser means disposed on the carriage and operable at different phases from the operative zones of the knitting and transfer locks on the carriage, said stitch pressing means comprising a pair of one-way operable stitch pressing means, one provided on one cam box of the carriage and having a stitch presser bar adapted to enter a gap between a pair of needle beds for slide contact with formed stitches during the movement of the carriage in one direction and the other provided on another cam box of the carriage and having a stitch presser bar adapted to enter said gap between the needle beds for slide contact with formed stitches during the movement of the carriage in the opposite direction, said one-way operable stitch pressing means each comprising a support means mounted on the front top surface of one of the cam boxes, a pair of sliders, upper and lower, individually slidably supported on said support means in substantially parallel relation to the needle tricks of the needle bed below the cam box opposite to the cam box on which said support means is mounted, a stitch-presser-bar mounting block pivotally connected at the base portion thereof to the front end portion of the lower slider and coupled at the upper free end thereof to the front end portion of the upper slider, a stitch presser bar secured at the base portion thereof to the upper end portion of the stitch-presser-bar mounting block, and drive means for said pair of sliders, said stitch presser bar being L-shaped and comprising a portion corresponding to the upper part of the vertical portion of "L" and at which it is secured to said mounting block, a portion corresponding to the lower part of said vertical portion and downwardly inclined toward the mounting block, and a portion corresponding to the horizontal portion of "L" and constituting an operative portion extending longitudinally of said gap between the needle beds, said drive means for the pair of sliders comprising pins individually projecting from the sliders, a pair of cam grooves individually engaging said pins, and a grooved cam plate carried by said support means slidably along the length of the needle beds, said pair of cam grooves having a cam surface for moving said upper and lower sliders to impart movement involving a circular mortion above the knockover comb to the front portion of said stitch presser bar for entry into and retraction from the gap between the needle beds, said sub-presser means comprising a mounting member having its lower end portion pivotally supported at a suitable location on said support means on the cam box and having its upper end portion adapted to move toward and away from a knockover comb, spring means urging the upper end portion of the mounting member in the forward direction, a stopper for stopping the urging force of the spring at a given forward position, and a sub-presser element secured at the base portion thereof to the upper end portion of the mounting member, said sub-presser element having its front end portion downwardly inclined at a point past the space right above the knockover comb and positioned in the gap between the needle beds, said front end portion having on its both sides a sled-shaped arcuate surface extending longitudinally of the needle beds and being constantly urged deeper into the gap than said stitch presser bar.

The stitch pressing means in accordance with the present invention, if provided in plurality on the support means correspondingly to the raising zones of the knitting and transfer locks disposed on each cam box, can effectively press down, by means of the horizontal portion thereof, stitches being formed by the needles as the needles are raised by these locks, thus preventing the stitches from rising.

On each cam box, however, there are provided, correspondingly to the raising zones of the raising cams of the knitting lock, brushes for keeping in open position the latches of needles raised from the opposite-side needle bed by the raising cams, said brushes being positioned with their hair ends facing the knockover comb of the opposite-side needle bed so that they can contact the latches of needles raised from the opposite-side needle bed.

Therefore, where the stitch pressing means according to the invention are disposed at raising zones of the knitting cam and along the width of the carriage, the horizontal portions of presser bars of the stitch pressing means are positioned at same phases as the brushes; accordingly, upon its circular motion above the knockover comb for retraction from its operative position or the gap between the needle bed, the horizontal portion of each presser bar may strike and deform the hair ends of said brush.

Another object of the invention is to provide a stitch pressing device in which the horizontal portion of the stitch presser bar thereof is not liable to damage the hair ends of a brush provided on a cam box during such circular motion thereof.

The stitch pressing device according to this invention. wherein the above object has also been achieved, comprises a brush provided on each cam box at substantially same phase as the horizontal portion of the stitch presser bar in the widthwise direction of the cam box, said brush being mounted to the front end portion of a brush-mounting member slidably carried on said support means in substantial parallelism with the upper and lower sliders, said brush being movable between its operative and non-operative positions relative to the needles of the needle bed on the opposite side, drive means for displacing said brush between the operative and non-operative positions thereof, said drive means including a pin projecting from said brush-mounting member, a cam groove formed on said grooved-cam plate and engaged by said pin, said cam groove having at least a cam surface for retracting said brush from the operative position thereof in synchronism with an early-stage retracting movement of said stitch presser bar.

The above and other related objects and features of the invention will be apparent from the following description and claims taken in connection with the accompanying drawings, forming a part of this application.

DESCRIPTION OF THE DRAWING

FIGS. 9-A-9-F are side views showing a stitch presser bar in various phases of operation;

DESCRIPTION OF THE PREFERRED EMBODIMENTS

Figure 1:
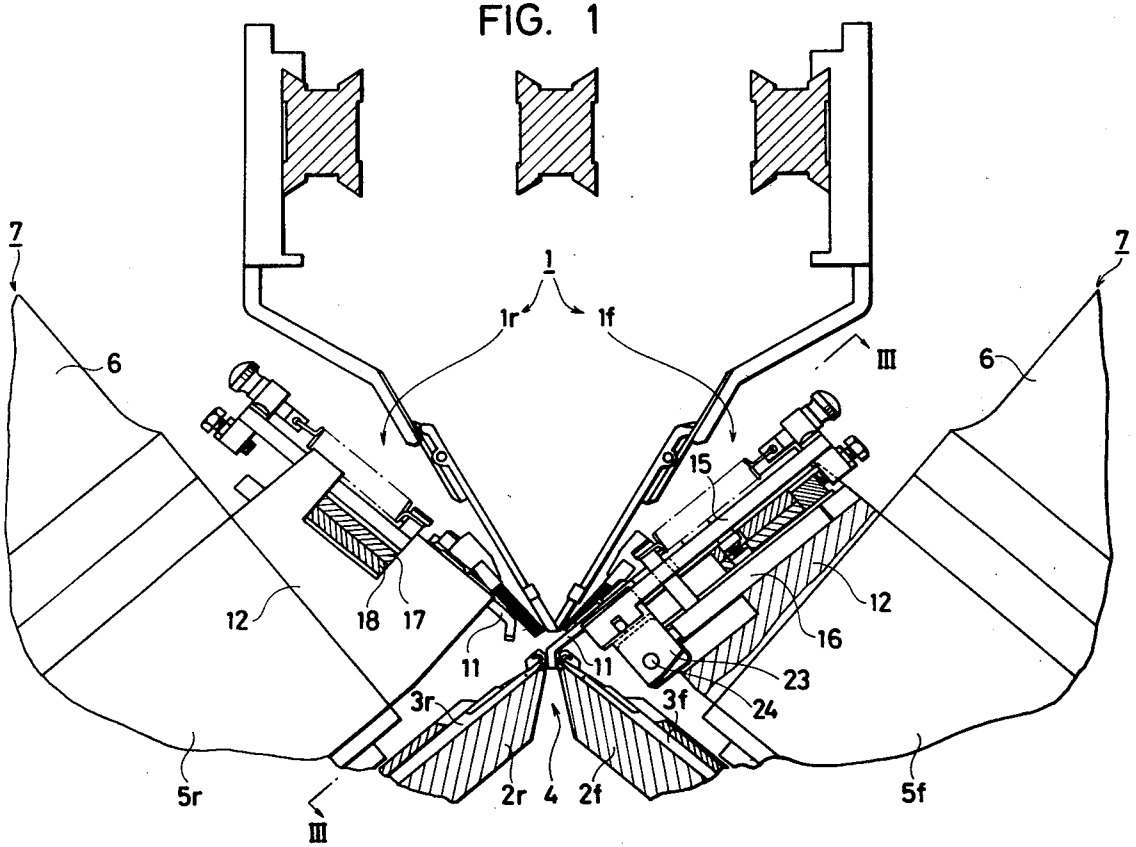
FIG. 1 is a side view, partly in longitudinal section, of a stitch pressing device embodying the present invention.

The stitch pressing device according to the present invention will now be described in detail with reference to the drawings which show one embodiment of the invention. In a flat V-bed knitting machine having a pair of needle beds 2*f*,2*r* arranged in an inverted-V pattern with a gap 4 formed therebetween so as to permit the needles 3*f*, 3*f* of the needle beds 2*f*, 2*r* to cross each other in the course of their upward movement and having a carriage 7 arranged reciprocably movably above the needle beds 2*f*, 2*r* and in the longitudinal direction thereof and comprising a pair of cam boxes 5*f*, 5*r* integrally connected to each other by an arm 6, each cam box being provided with knitting cams which act on the needles 3*f*, 3*r* of the needle beds 2*f*, 2*r* during knitting operation, the stitch pressing device of the invention includes pairs of stitch pressing means 1*f*, 1*r* (the entirety of which is generally designated by numeral 1), said stitch pressing means 1*f* being provided on the cam box 5*f* and operable at substantially same phases as the operative zones of knitting and/or transfer locks during the movement of the carriage 7 in one direction, said counterpart stitch pressing means 1r being provided on the cam box 5r and similarly operable during the movement of the carriage 7 in the opposite direction, so that the stitch pressing means 1 as a whole are operable at substantially same phases as the operative zones of the knitting and/or transfer locks during the movement of the carriage 7, both ways.

Figure 2:
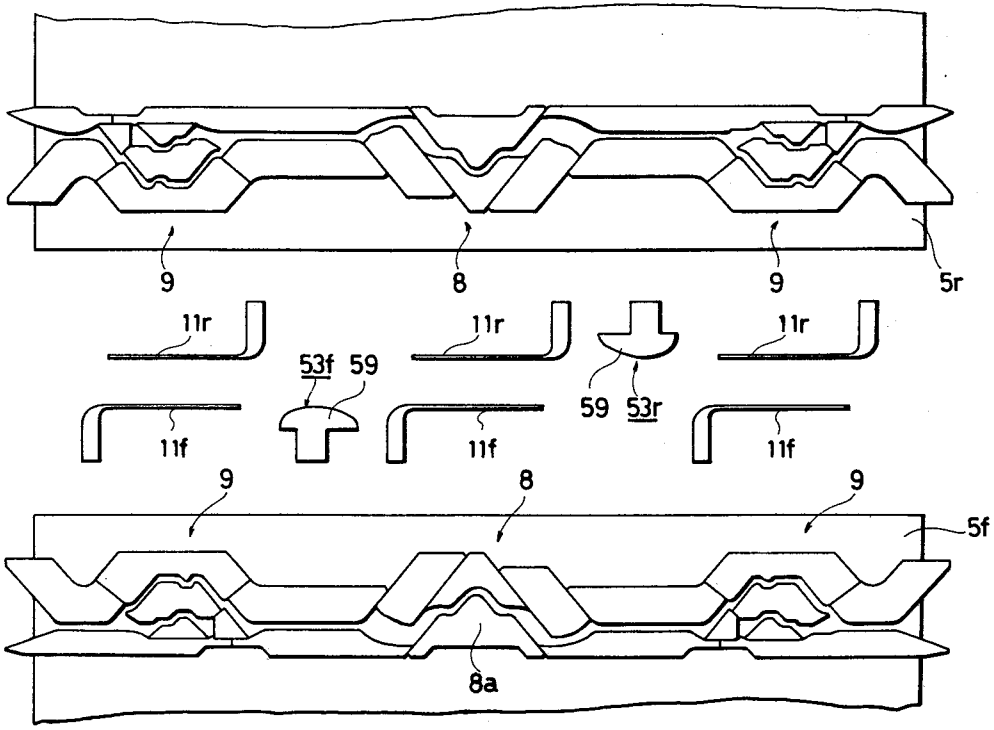
FIG. 2 is a schematic illustration of positions of stitch presser bars relative to cams provided in a cam box as viewed along the path of movement of the carriage.

In the flat knitting machine incorporating the embodiment of the invention, as FIG. 2 shows, a knitting lock 8 is centrally disposed in each of the cam boxes 5f, 5r in the direction of movement of the carriage 7, with transfer locks 9, 9 disposed on both sides of the knitting lock 8, and stitch pressing means 1 are disposed correspondingly to the individual operative zones of knitting locks 8 and transfer locks 9, 9, that is, pairs of one-way operable stitch pressing means 1f, 1r for the operative zones of the locks 8, 9, 9, the stitch pressing means 1f being operable during the movement of the carriage in one direction and the counterpart stitch pressing means 1r operable during the movement of the carriage in the opposite direction. In FIG. 2 there are schematically shown dispositions, in the longitudinal direction of the cam boxes 5f, 5r, of pairs of stitch pressing means 1f, 1r as represented by stitch presser bars 11f, 11r which are extensible from the stitch pressing means 1f, 1r into the gap 4 between the needle beds 2f, 2r for sliding contact with the stitches being formed.

As can be noted from FIGS. 1 and 2, three pairs of stitch pressing means 1f, 1r are each symmetrically disposed on the opposed surfaces of the cam boxes 5f, 5r. Since the stitch pressing means 1f disposed on cam box 5f and the counterpart 1r thereto disposed on cam box 5r are of same structure, description hereinafter will be centered on stitch pressing means 1f disposed on cam box 5f with reference to FIG. 3 *ff.*

Figures 1, 3:
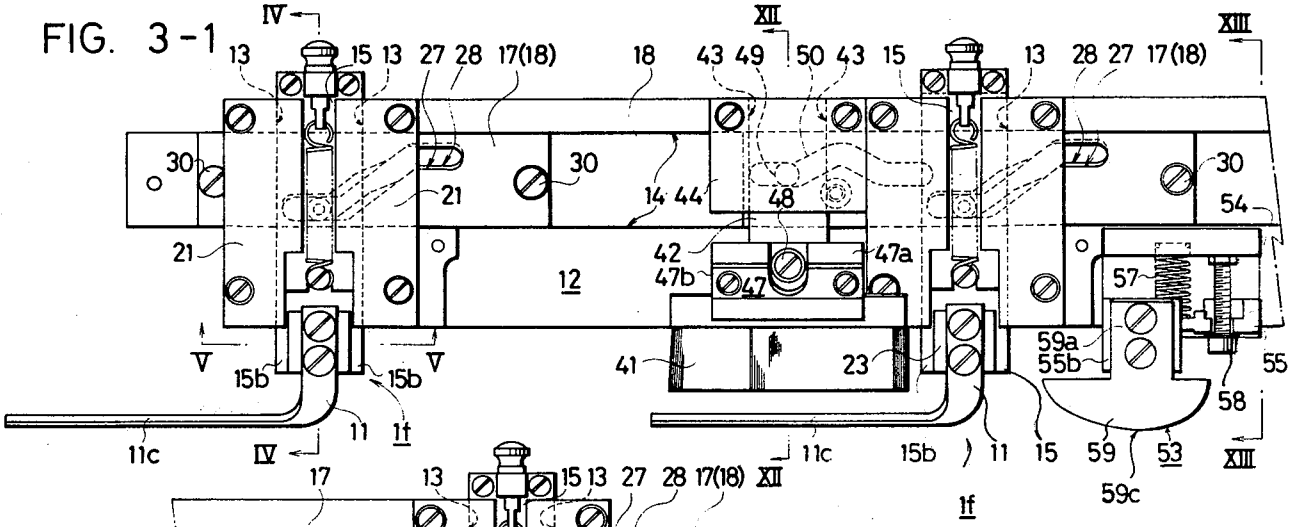
FIG. 3 is a plan view of one-way operable stitch pressing means mounted on the front top surface of one cam box (as taken in the direction of the arrows along the line III-III in FIG. 1)
Figures 2, 3:
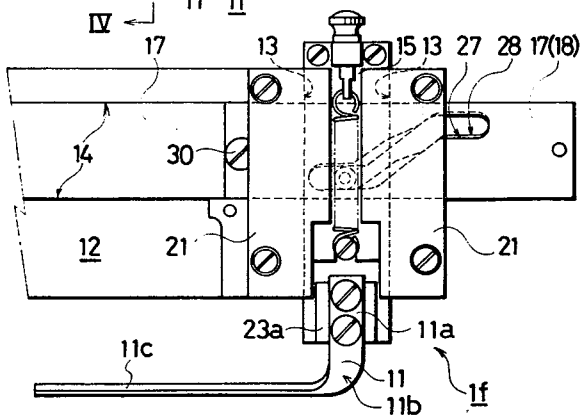

The three stitch-pressing means 1f (on the cam box 5f) are disposed at three locations on support means 12, substantially of a block structure, mounted on front top surface 5a of the cam box 5f (said front top surface 5a is shown substantially as a plane in FIG. 3 *ff.*).

Figure 5:
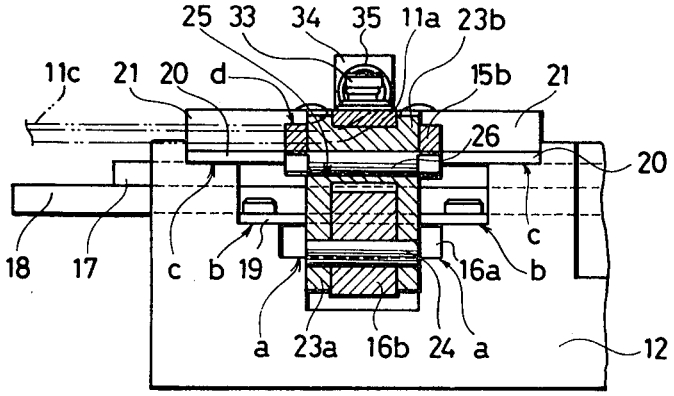
FIG. 5 is a section taken on line V—V in FIG. 4.
Figure 6:
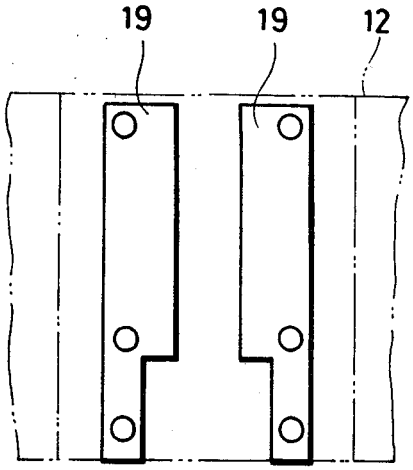
FIG. 6 is a plan view of lower spacers.
Figure 7:
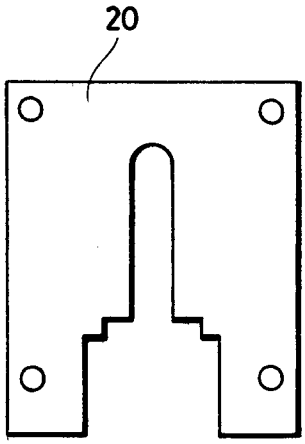
FIG. 7 is a plan view of an upper spacer.
Figure 8:
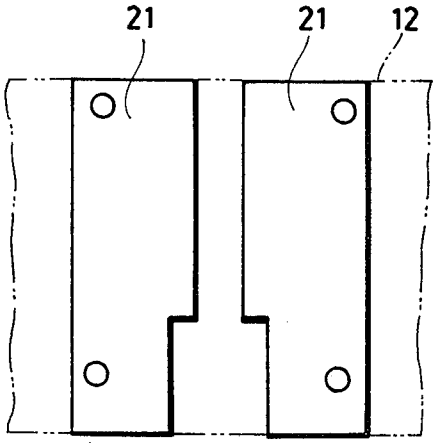
FIG. 8 is a plan view of keep plates.

As can be seen from FIG. 4 which shows a section taken on the line IV—IV in FIG. 3-1, as well as from FIG. 5 which shows a section taken on the line V—V in FIG. 4, on the support means 12 on which stitch pressing means 1f are disposed there is formed a groove 13 transversely of the support means 12 at each location at which a stitch pressing means is provided, said groove 13 being substantially parallel to the needle tricks of the needle bed 2 below the opposite side cam box 5r. On the support means 12 there is also formed a groove 14 rectangular to the groove 13 and extending in the longitudinal direction of the support means 12. In the groove 13 there are provided, at different levels, an upper slider 15 and a lower slider 16, both extending in the transverse direction of the support means 12. In the groove 14 there are provided grooved cam plates 17, 18 between the upper and lower sliders 15 and 16, said grooved cam plates 17, 18 integrally fixed to each other, plate 17 placed on plate 18, and extending in the longitudinal direction of the support means 12. To explain more specifically with reference to FIG. 5, in the groove 13 there are formed at three different levels three pairs of steps a, a, b, b, c, c extending along the length of the groove 13, each of symmetrical configuration so that the width of the groove 13 becomes larger step after step upward. A pair of lower spacers 19 having a planar configuration as shown in FIG. 6 are fixed on the steps b, b, and between the underside of the lower spacers 19 and the steps a, a there is back and forth movably supported a flat portion 16a of the lower slider 16 (here, forward direction is understood to be toward the needle bed 2f). An upper spacer 20 having a planar configuration as shown in FIG. 7 is secured to the step c. Upper and lower surfaces of the grooved cam plates 17, 18 (which are integrally secured to each other at three points, with plate 17 placed on plate 18) are supported back and forth slidably along the groove 14 between the underside of the upper spacer 20 and the top surface of the lower spacer 19. A pair of guide blocks 21, 21 having a planar configuration as shown in FIG. 8 is fixed, together with the upper spacer 20, on the support means 12, being held in abutment relation with the top surface of side portions of the upper spacer 20. Between ledge portions d, d of the guide blocks 21, 21 and the upperside of the top spacer 20 there is back and forth movably supported a flat portion 15a of the upper slider 15.

A leg portion 23a of a stitch-presser-bar mounting block 23 is pivotally connected to the front portion 16b of the lower slider 16. Said mounting block 23 has a hole 25 formed in the head portion 23b thereof, a pin 26 being rotatably fitted in the hole 25. Upper end of the pin 26 is engaged in a downward groove 29 (see FIG. 9) formed on a forked front end 15b of the upper slider 15. The stitch presser-bar mounting block 23, thus pivotally connected at the lower portion thereof or at 24 to the front portion 16b of the lower slider 16 and connected at the upper free end thereof to the front portion 15b of the upper slider 15 through the engagement of the pin 26 with the groove 29, is adapted to move back and forth in one with the upper and lower sliders 15, 16 if the slider 15, 16 are simultaneously moved at samd speed, and to pivot at 24 if the sliders are moved at relatively different speeds. To the top of the mounting block 23 is attached the base portion 11a of the stitch presser bar 11.

Figure 4:
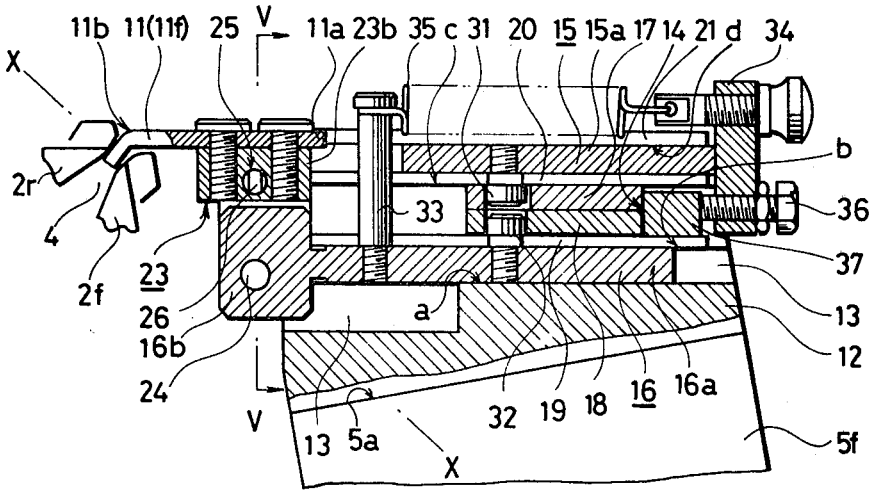
FIG. 4 is a section taken on line IV—IV in FIG. 3.

As can be seen from FIGS. 3 and 4, the stitch presser bar 11 is L-shaped. The top of vertical portion of the L configuration constitutes the base portion 11a at which the stitch presser bar 11 is mounted on the mounting block 23. The lower part of said vertical portion is slightly downwardly bent at 11b toward the mounting block 23. The horizontal portion 11c extending from the lower end of the vertical portion of L constitutes operative portion 11c adapted for entry into the gap between the needle beds 2f, 2r and extending longitudinally of the gap.

Figure 11:
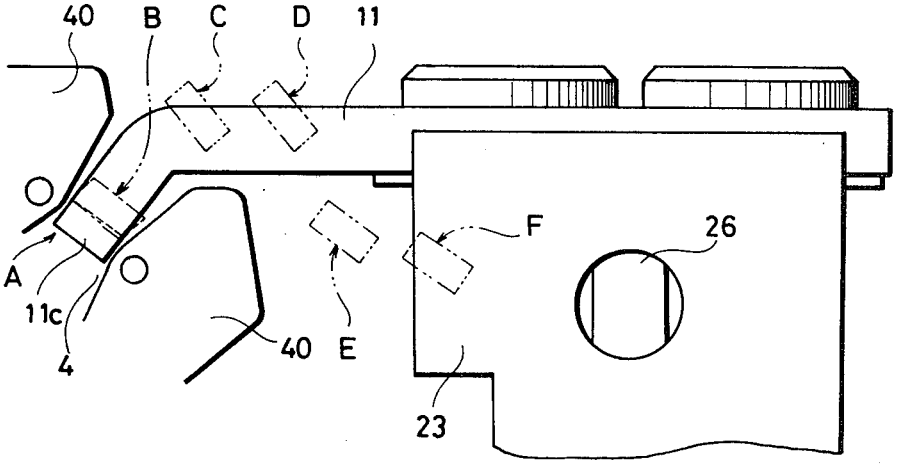
FIG. 11 is a side view showing the trail of movement of a stitch-presser bar's working part.
Figure 12:
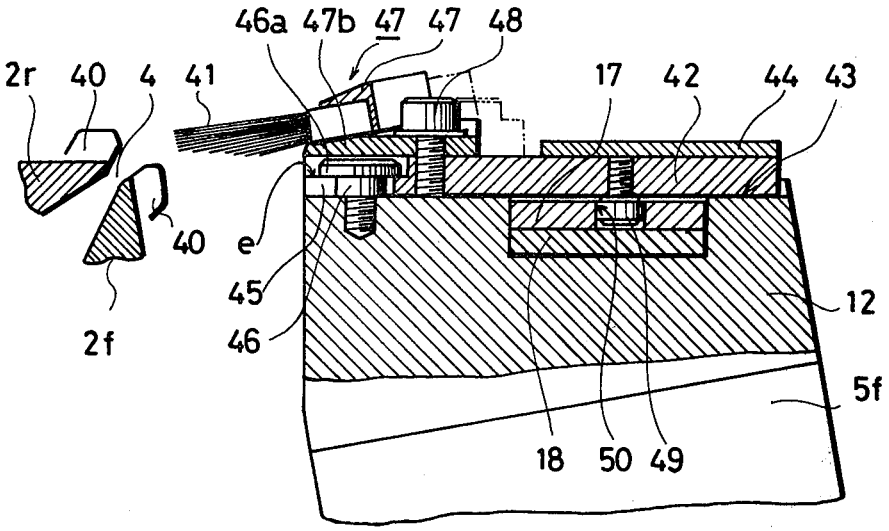
FIG. 12 is a longitudinal sectional view in side elevation of a brush mounting block (as taken on line XII—XII in FIG. 3)

In short, the stitch presser bar 11 is carried on the support means 12 back and forth movably, and pivotably about pin 24, through the stitch-pressing-bar mounting block 23 and upper and lower sliders 15, 16. In order to allow advancing, retracting and swinging movement of the stitch presser bar following a certain trail, there are provided cam grooves 27, 28 on the grooved cam plates 17, 18 consisting of plate 17 integrally fixed on plate 18. On the lower slider 16 there is rotatably mounted a roller 32 which engages the cam groove 28 of the lower grooved cam plate 18, and the upper slider 15 has a roller 31 rotatably mounted to it, said roller 31 engaging the cam groove 27 of the upper grooved cam plate 17. So, if the upper and lower cam plates 17, 18, integrally coupled by pin 30, are moved right to left and vice versa, the stitch presser bar 11 is given forward and backward movement, including circular or swinging movement, accordingly, as illustrated in FIGS. 9 and 11.

In the stitch pressing device 1 shown, as can be best seen from FIG. 4, between a pin 33 disposed adjacent the front end of the lower slider 16 and a plate 34 fixed to the rear end of the upper slider 15, there are provided spring means 35 exerting some spring action, in cooperation with the cam grooves 27, 28, to the stitch presser bar 11 brought to its operative position in the gap 4. Further, for the purpose of adjusting the spring action, a bolt 36 screwed into the lower part of the plate 34 is in abutment at its front end with a stopper 37 abutting the upper surface of the spacer 19 and secured by bolt (not shown) to the steps b, b of the support means 12.

Figure 10:
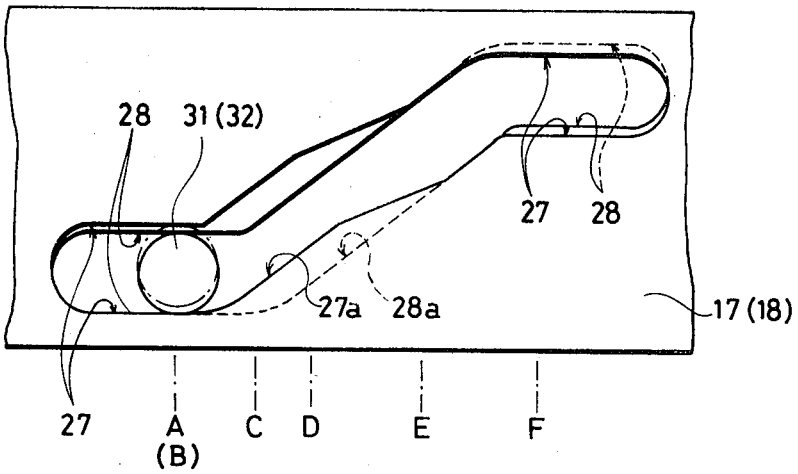
FIG. 10 is a partly cut-away plan view of a grooved cam plate, showing cam grooves therein.

The upper and lower cam grooves 27, 28 for imparting above described motion to the stitch presser bar 11 in accordance with the invention are illustrated in detail in FIG. 10. The cam grooves 27, 28 and the upper and lower rollers 31, 32 thereby guided are constantly at same phase in the operating direction (right-to-left) of the grooved cam plates 17, 18. Therefore, if the cam grooves 27, 28 are made different from each other in configuration as illustrated in FIG. 10, the upper and lower rollers 31, 32, when at position A in the individual grooves 27, 28, are kept at their forwardmost position shown by solid line in the figure. At this position A, the width of the upper cam groove 27 is slightly larger than that of the lower cam groove 28. Accordingly, the upper roller 31 is back and forth movable to some extent in the cam groove 27. However, the upper slider 15 is constantly urged to it forward position relatively by spring means 35 extending between it and the lower slider 16. Therefore, as FIG. 10 shows, the upper roller 31, positioned right above the lower roller 32, holds the upper slider 15 at the forwardmost position and accordingly the stitch presser bar 11 at the forwardmost position thereof as shown in FIG. 9-A. Since the stitch presser bar 11 is such that the lower end of the vertical portion of "L" is downwardly inclined at 11*b* toward the mounting block 23, when it is at this position, the presser bar 11 has its operative portion 11*c* corresponding to the horizontal portion of "L" positioned within the gap 4 between the needle beds 2*f*, 2*r* longitudinally of the gap 4.

In the stitch pressing device shown as embodying the invention, the width of the upper cam groove 27 is larger at position A than the diameter of the roller 31, and between the upper and lower sliders 15 and 16 there are provided spring means 35; so, the stitch presser bar 11 is swingable with a circular motion against the action of the spring means 35 urging it forward and to the extent that the upper roller 31 can retract to position B shown by chain line in FIG. 10, the operative portion 11*c* being thus allowed to move upward to the position shown in FIG. 9-B.

For this purpose, at the forwardmost position of the lower slider 16 shown in FIGS. 9-A and 9-B, the point 24 at which the mounting block 23 for the stitch presser bar 11 is pivoted is established so that it is positioned substantially on an extention of a virtual line X—X connecting between the upper ends of needle tricks of the two needle beds 2*f*, 2*r*.

Inclined cam surfaces 27*a*, 28*a* are provided for retracting both upper and lower sliders 15 and 16 from said forwardmost position or position A at which the sliders are retained by cam grooves 27, 28 acting upon the rollers 31, 32. As FIG. 10 shows, the cam surfaces 27*a*, 28*a* are in different phase from each other so that if grooved cam plate 17, 18 are moved to left direction in FIG. 10, the lower roller 32 does not begin retraction until the upper roller 31 is caused to move backward a certain distance by a portion of the cam groove 27*a* while the lower roller 32 is kept in its forward position. When the upper and lower rollers 31, 32 has reached position C shown in FIG. 10, the operative portion 11*c* of the stitch presser bar 11 gets out of the gap between the needle beds moving in an arc (FIG. 9-C). Subsequently, retraction of the lower roller 32 is started and thereupon the upper and lower sliders 15, 16 are moved backward at same speed. After the operative portion 11*c* of the stitch presser bar has thus passed over the knockover comb 40, that is phase D in FIG. 10 (FIG. 9-D), the presser bar 11 is again given circular motion by decreasing the retracting speed of the upper slider 15 relative to that of the lower slider 16. When the upper and lower rollers 31, 32 have reached phase E in FIG. 10, the operative portion 11*c* of the presser bar 11 is positioned at a lower level than an extension of the bottom of needle tricks 3*r* of the needle bed 2*r* on the opposite side as shown in FIG. 9-E, being caused to continue backward movement to its retracted position without getting above the level of that extension.

The cam grooves 27, 28 shown in FIG. 10 are arranged so that the operative portion 11*c* of the stitch presser bar 11, during its retracting movement, may not strike or damage the hair ends of a brush 41 provided on cam box 5*f* at substantially same phase as the operative zone of the presser bar 11, when the stitch pressing device of the invention is applied at same operative zone as that of a knitting lock 8. That is, at phase F shown in FIG. 10, the lower cam groove 28 is off the position of the upward cam groove 27 rather backwardly. When the rollers 31, 32 reach said phase F, therefore, the lower slider 16 is more backwardly positioned than the upper slider 15, and as shown in FIG. 9-F, the operative portion 11*c* of the presser bar 11 is positioned lower than the level shown in FIG. 9-E.

If the grooved cam plates 17, 18, when in such position as shown in FIG. 9-F, are moved to right direction in FIG. 10, the stitch presser bar 11 is caused to advance with a circular motion in the opposite direction to enter into the gap 4 between the needle beds 2*f*, 2*r* passing over the knockover comb 40.

The trails of movement of the stitch presser bar 11 corresponding to the individual phases A–F referred to above are shown by chain line in FIG. 11.

Since the operative portion 11*c* of the stitch presser bar 11 is adapted to advance and retract following such trails, if the stitch pressing device 1 of the present invention is applied at same phase as the operative zone of the knitting lock 8, said operative portion 11*c*, when it is in circular motion for passing over the knockover comb 40, may possibly damage and deform the hair ends of a brush 41 disposed on the cam box 5*f* in same phase as the stitch presser bar and adapted to act on latches of needles 3*r* raised from the needle bed 2*r* on the opposite side for keeping them in open position.

Where the stitch pressing device 1 is disposed at a location at which such brush 41 is present, that is, in the case of the embodiment herein, if the device 1 is disposed centrally of the cam box 5, for example, a brush 41 is provided on the cam box 5*f* in substantially same phase as the horizontal portion or operative portion 11*c* of the presser bar 11 in the widthwise direction of the cam box 5*f*. The brush 41 is mounted on a brush mounting member 42 (as described below) disposed on the support means 12.

The brush mounting member 42 has side (both sides of rear portion) and bottom surfaces guided by a groove 43 formed on the support means 12 in parallel relation to the groove 13, and a rear top surface guided by a guide plate 44 which is mounted across the groove 43 and fixed on the support means 12. Its front portion is guided above the cam plate 17 through a slidable engagement between a groove 45 having a step e and head 46*a* of a pin 46 projecting upwardly from the support means 12. On the front upperside of the mounting member 42 there is secured, by bolt 48, a lower-side member 47*b* of a clip which consists of two members 47*a*, 47*b*.

On the underside of the brush mounting member 42 there is rotatably carried a roller 49 which engages a cam groove 50 formed on the grooved cam plate 17. Thus, when the integrally coupled cam plates 17, 18 are actuated to move the stitch presser bar 11, the brush 41 moves in conjunction with the presser bar 11. As the operative portion 11*c* of the presser bar 11 approaches from position A to position C in FIG. 11 in the course of its retraction, the brush 41 begins to retract, but this retraction takes place with a certain distance maintained between the brush 41 and the operative portion 11*c* of the presser bar 11. After said operative portion 11*c* has reached position D in FIG. 11 past the knockover comb 40, the brush 41 gets to its rearwardmost position and then begins forward movement; and the brush 41 returns to its operative position (forward position) after its passage above the operative portion 11*c* of the presser bar 11 at position E in FIG. 11.

Figure 13:
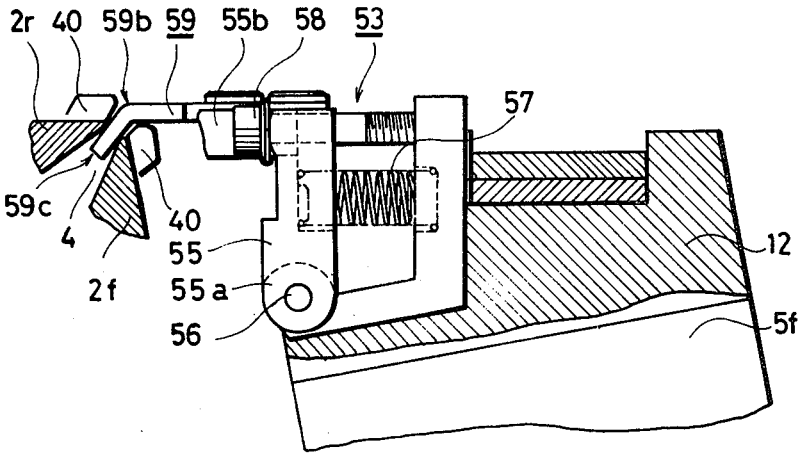
FIGS. 13 and 14 are longitudinal sections of sub-presser means (as taken on line XIII—XIII in FIG. 3)
Figure 14:
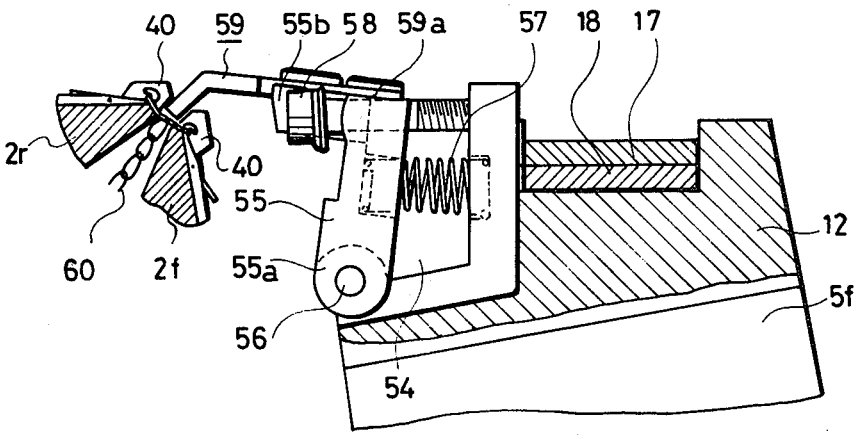

Next, sub-presser means, another constituent feature of the present invention, will be described. In the case of a flat knitting machine employing single-cam-type cam boxes, where one-way stitch pressing devices 1 are individually provided in operative zones of knitting locks 8, one each centrally disposed on a pair of cam boxes 5*f*, 5*r*, and of transfer locks 9, 9, two disposed on each cam box individually on both sides of the knitting lock, a pair of sub-presser means 53*f*, 53*r* may be provided, that is, one on each cam box between the centrally disposed pressing means 1*f* or 1*r* and one 1*f* or 1*r* on either side thereof (for example, one on the forward side in the direction of operation). By way of example, one sub-presser means 53*f* is described herein with reference to FIGS. 3, 13 and 14. The sub-press means 53 comprises a mounting member 55 pivotally supported (at 56) at the lower end portion 55*a* thereof in a recess 54 formed on the front surface of the support means 12 and having a movable upper end portion 55*b*, spring means 57 constantly urging said upper end portion 55*b* in the direction of forward movement, a stopper 58 for stopping the spring force at a given forward position, and a sub-presser element 59 having a base portion 59*a* secured to the upper end portion 55*b* of the mounting member 55. The sub-presser element 59 has its front portion inclined downwardly at 59*b*, a point past the overhead area of the knockover comb 40, with its front end 59*c* inserted deeper into the gap 4 between the needle beds 2*f*, 2*r* than the horizontal portion 11*c* of the stitch presser bar 11 and resiliently kept in that position under the urging force of the spring 57. The sub-presser element is different from the stitch pressing means 1 in that one sub-presser element is operable during the reciprocation of the carriage 7, and for this purpose it is inverted-mushroom shaped in front configuration, and has sled-shaped arcuate side surfaces at its end in the direction movement of the carriage.

As already mentioned, the stitch pressing device in accordance with the invention comprises a combination of stitch pressing means provided on the carriage at substantially same phases as the operative zones of knitting and transfer locks and sub-presser means provided on the carriage in different operative zone as those of the knitting and transfer locks. Further, the stitch pressing means and sub-presser means are respectively comprised as above described. Accordingly, the stitch pressing device of the invention has the following advantages.

Figure 15:
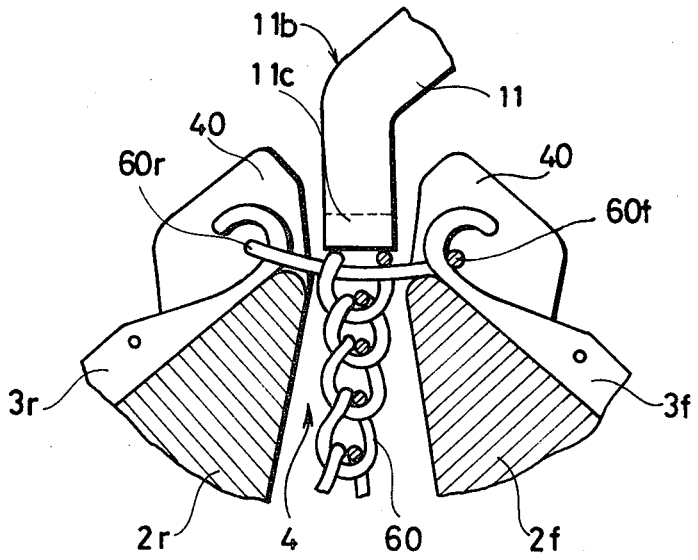
FIG. 15 is an explanatory illustration of the operation of the stitch presser bar.

As can be understood from the above description, when the integral grooved cam plates 17, 18 are driven rightward or eftward, the horizontal portion or operative portion 11*c* of the stitch presser bars 11*f*, or 11*r* enters the gap 4 between the needle beds 2*f*, 2*r*, and as FIG. 15 shows, it presses down the uppermost row of stitches 60*f*, 60*r* extending between needles 3*f*, 3*r* in the needle beds 2*f*, 2*r* so that the stitches 60*f*, 60*r* are prevented from rising as a result of needles 3*f*, 3*r* being raised by locks 8, 9 for knitting or transfer operation. Since individual one-way stitch presser bars 11*f*, 11*r* are supported on a pair of support means 12, 12 disposed on cam boxes 5*f*, 5*r*, and since they are individually controlled for advance and retraction between operative position (FIG. 9-A) and rest position (FIG. 9-F) through movement involving such circular motion as shown in FIGS. 9 and 11, their movement between the operative and non-operative positions can be effectively controlled at any desired position in the longitudinal direction of the needle beds 2*f*, 2*r* during the run of the carriage 7, without the necessity of the carriage 7 being moved beyond the length of the needle beds 2*f*, 2*r* and without being affected by the presence of knockover comb.

Therefore, even if the carriage is given a minimum stroke of movement that cams in the cam box require for knitting and/or transfer operation, the stitch pressing device can be effectively caused to perform stitch pressing operation by driving said grooved cam plate rightward or leftward at the start of return movement of the carriage for changeover from one-way presser bars operable in one direction to one-way presser bars operable in the opposite direction.

Such stitch pressing device, therefore, is particularly suitable for use as stitch presser in fashioned knitting and offers an advantage that the carriage need not be overrun beyond the length of the needle beds, which naturally means more efficient knitting operation.

Furthermore, since the stitch pressing means, disposed on a pair of cam boxes, are controllable, do not block the space above the gap between the needle beds; so, the stitch pressing device of the invention can be effectively applied to flat V-bed knitting machines without sacrificing the space for the provision of many yarn carier guide means. In other words, the stitch pressing means in accordance with the invention occupies that part of the space above the needle beds which is slightly above the knockover comb. The rest of the space above the gap can be fully utilized for provision of yarn carrier control means.

Next, operation of the sub-presser means 53 is described. As can be seen from FIGS. 2, 3, 13 and 14, the presser bars 11*f*, 11*r* of the stitch pressing means 1*f*, 1*r* are not adapted to enter deep into the gap 4 at their operative position. Although the presser bars 11*f*, 11*r* can press down stitches 60*f*, 60*r* extending between needles 3*f*, 3*r* in the needle beds 2*f*, 2*r*, as shown in FIG.

Figure 16:
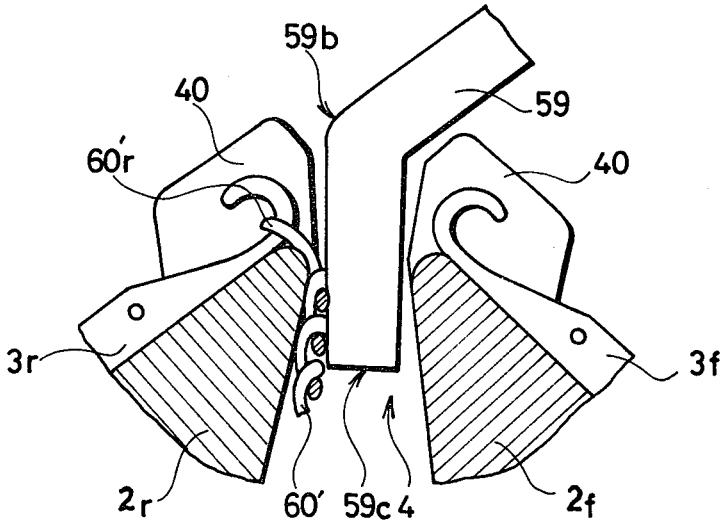
FIG. 16 is an explanatory illustration of the operation of a sub-presser element.

15, to prevent them from rising, they may not effectively hold down stitches 60'r or 60'f depending from needles 3r or 3f of one needle bed 2r or 2f only against rising. On the other hand, however, sub-presser element 59 provided intermediate between two presser bars on the front or rear side in the direction of movement of the carriage is adapted to act on stitches 60, 60' and is positioned more deeply in the gap 4, being urged by spring means toward the gap 4 and kept by the spring in that position. As such, the sub-presser element 59 presses down stitches 60 extending between needles 3f, 3r (rib stitch) while its lower end being pushed upwardly against the force of the spring 57 to a position shown in FIG. 14. In the case of stitches 60' depending from needles 3r or 3f in one of the needle beds 2r, or 2f (plain stitch), as FIG. 16 shows, the front end 59c acts on such plain stitches 60' depending from needles 3r, pressing down to prevent them from rising.

If such sub-presser means 53 are provided on the carriage at front or rear side of a one-way operable stitch pressing means or on both sides thereof, stitches being knitted are pressed down by the presser and sub-presser means covering the entire width of the carriage each time the carriage runs above them, and therefore, stitch pressing operation can be efficiently performed by the stitch pressing and sub-presser means according to the invention in knitting of any desired stitches including plain, without employing take-down roller or similar machanism.

According to this invention, in any operative zone of knitting lock where the horizontal portion of a stitch presser bar is present, a brush for the operative zone is disposed on a brush mounting member slidably arranged in substantially parallel relation to upper and lower sliders adapted for advancing and retracting the presser bar. When the presser bar is retracting, the brush is caused to retract synchronously with an early phase of the movement of the presser bar involving circular motion, while the horizontal portion of the presser bar is caused to move downward relative to the brush without striking the hair ends of the brush. Therefore, the brush is unlikely to be damaged by retracting movement of the presser bar.

The invention may be embodied in other specific forms without departing from the spirit or essential characteristics thereof. The present embodiment is therefore to be considered in all respects as illustrative and not restrictive, the scope of the invention being indicated by the appended claims rather than by the foregoing description and all changes which come within the meaning and range of equivalency of the claims are therefore intended to be embraced therein.

What is claimed is:

1. A stitch pressing device for flat knitting machine, comprising stitch pressing means arranged on a carriage and operable at substantially same phases as the operative zones of knitting and transfer locks on the carriage, and sub-presser means disposed on the carriage and operable at different phases from the operative zones of the knitting and transfer locks on the carriage, said stitch pressing means comprising a pair of one-way operable stitch pressing means, one provided on one cam box of the carriage and having a stitch presser bar adapted to enter a gap between a pair of needle beds for slide contact with formed stitches during the movement of the carriage in one direction and the other provided on another cam box of the carriage and having a stitch presser bar adapted to enter said gap between the needle beds for slide contact with formed stitches during the movement of the carriage in the opposite direction, said one-way operable stitch presser means each comprising a support means mounted on the front top surface of one of the cam boxes, a pair of sliders, upper and lower, individually slidably supported on said support means in substantially parallel relation to the needle tricks of the needle bed below the cam box opposite to the cam box on which said support means is mounted, a stitch-presser-bar mounting block pivotally connected at the base portion thereof to the front end portion of the lower slider and coupled at the upper free end thereof to the front end portion of the upper slider, a stitch presser bar secured at the base portion thereof to the upper end portion of the stitch-presser-bar mounting block, and drive means for said pair of sliders, said stitch presser bar being L-shaped and comprising a portion corresponding to the upper part of the vertical portion of "L" and at which it is secured to said mounting block, a portion corresponding to the lower part of said vertical portion and downwardly inclined toward the mounting block, and a portion corresponding to the horizontal portion of "L" and constituting an operative portion extending longitudinally of said gap between the needle beds, said drive means for the pair of sliders comprising pins individually projecting from the sliders, a pair of cam grooves individually engaging said pins, and a grooved cam plate carried by said support means slidably along the length of the needle beds, said pair of cam grooves having a cam surface for moving said upper and lower sliders to impart movement involving a circular motion above the knockover comb to the front portion of said stitch presser bar for entry into and retraction from the gap between the needle beds, said sub-presser means comprising a mounting member having its lower end portion pivotally supported at a suitable location on said support means on the cam box and having its upper end portion adapted to move toward and away from the knockover comb, spring means urging the upper end portion of the mounting member in the forward direction, a stopper for stopping the urging force of the spring at a given forward position, and a sub-presser element secured at the base portion thereof to the upper end portion of the mounting member, said sub-presser element having its front end portion downwardly inclined at a point past the space right above the knockover comb and positioned in the gap between the needle beds, said front end portion having on its both sides a sled-shaped arcuate surface extending longitudinally of the needle beds and being constantly urged deeper into the gap than said stitch presser bar.

2. A stitch pressing device for flat knitting machine as set forth in claim 1, wherein that part of the cam groove provided on said grooved cam plate which is adapted to retain said upper slider in the forwardmost position is slightly larger in width than the diameter of the pin projecting from the upper slider and engaging said cam groove and wherein said upper slider, in the forward position, is movable back and forth relative to the lower slider within a backlash which permits the pin to move back and forth in the cam groove and is resiliently urged toward the forward position by spring means provided between the upper and lower sliders.

3. A stitch pressing device for flat knitting machine as set forth in claim 1 or 2, wherein said upper slider is provided with adjusting means for decreasing and adjusting the distance of movement of the upper slider at the forwardmost position as allowed by said backlash.

4. A stitch pressing device for flat knitting machine as set forth in claim 1, wherein the point at which said stitch-presser-bar mounting block is pivotally connected at its base portion to the lower slider is disposed so that it is positioned substantially on an extension of a virtual line connecting between the upper ends of needle tricks of the two needle beds when the lower slider is advanced to the forwardmost position.

5. A stitch pressing device for flat knitting machine as set forth in claim 1, wherein the point at which said mounting member for sub-presser means is pivotally supported on said support means is positioned substantially on an extension of a virtual line connecting between the upper ends of needle tricks of the two needle beds.

6. A stitch pressing device for flat knitting machine, comprising stitch pressing means arranged on a carriage and operable at substantially same phases as the operative zones of knitting and transfer locks on the carriage, and sub-presser means disposed on the carriage and operable at different phases from the operative zones of the knitting and transfer locks on the carriage, said stitch pressing means comprising a pair of one-way operable stitch pressing means, one provided on one cam box of the carriage and having a stitch presser bar adapted to enter a gap between a pair of needle beds for slide contact with formed stitches during the movement of the carriage in one direction and the other provided on another cam box of the carriage and having a stitch presser bar adapted to enter said gap between the needle beds for slide contact with formed stitches during the movement of the carriage in the opposite direction, said one-way operable stitch pressing means each comprising a support means mounted on the front top surface of one of the cam boxes, a pair of sliders, upper and lower, individually slidably supported on said support means in substantially parallel relation to the needle tricks of the needle bed below the cam box opposite to the cam box on which said support means is mounted, a stitch-presser-bar mounting block pivotally connected at the base portion thereof to the front end portion of the lower slider and coupled at the upper free end thereof to the front end portion of the upper slider, a stitch presser bar secured at the base portion thereof to the upper end portion of the stitch-presser-bar mounting block, and drive means for said pair of sliders, said stitch presser bar being L-shaped and comprising a portion corresponding to the upper part of the vertical portion of "L" and at which it is secured to said mounting block, a portion corresponding to the lower part of said vertical portion and downwardly inclined toward the mounting block, and a portion corresponding to the horizontal portion of "L" and constituting an operative portion extending longitudinally of said gap between the needle beds, said drive means for the pair of sliders comprising pins individually projecting from the sliders, a pair of cam grooves individually engaging said pins, and a grooved cam plate carried by said support means slidably along the length of the needle beds, said pair of cam grooves having a cam surface for moving said upper and lower sliders to impart movement involving a circular motion above the knockover comb to the front portion of said stitch presser bar for entry into and retraction from the gap between the needle beds, said sub-presser means comprising a mounting member having its lower end portion pivotally supported at a suitable location on said support means on the cam box and having its upper end portion adapted to move toward and away from a knockover comb, spring means urging the upper end portion of the mounting member in the forward direction, a stopper for stopping the urging force of the spring at a given forward position, and a sub-presser element secured at the base portion thereof to the upper end portion of the mounting member, said sub-presser element having its front end portion downwardly inclined at a point past the space right above the knockover comb and positioned in the gap between the needle beds, said front end portion having on its both sides a sled-shaped arcuate surface extending longitudinally of the needle beds and being constantly urged deeper into the gap than said stitch presser bar, a brush provided on each cam box at substantially same phase as the horizontal portion of the stitch presser bar in the widthwise direction of the cam box, said brush being mounted to the front end portion of a brush mounting member slidably carried on said support means in substantial parallelism with the upper and lower sliders, said brush being movable between its operative and non-operative positions relative to the needles of the needle bed on the opposite side, drive means for displacing said brush between the operative and non-operative positions thereof, said drive means including a pin projecting from said brush mounting member, a cam groove formed on said grooved cam plate and engaged by said pin, said cam groove having at least a cam surface for retracting said brush from the operative position thereof in synchronism with an early-stage retracting movement of said stitch presser bar.

7. A stitch pressing device for flat knitting machine as set forth in claim 6, wherein that part of the cam groove provided on said grooved cam plate which is adapted to retain said upper slider in the forwardmost position is slightly larger in width than the diameter of the pin projecting from the upper slider and engaging said cam groove and where said upper slider, in the forward position, is movable back and forth relative to the lower slider within a backlash which permits the pin to move back and forth in the cam groove and is resiliently urged toward the forward position by spring means provided between the upper and lower sliders.

8. A stitch pressing device for flat knitting machine as set forth in claim 6 or 7, wherein said upper slider is provided with adjusting means for decreasing and adjusting the distance of movement of the upper slider at the forwardmost position as allowed by said backlash.

9. A stitch pressing device for flat knitting machine as set forth in claim 1, wherein the point at which said stitch-presser-bar mounting block is pivotally connected at its base portion to the lower slider is disposed so that it is positioned substantially on an extension of a virtual line connecting between the upper ends of needle tricks of the two needle beds when the lower slider is advanced to the forwardmost position.

10. A stitch pressing device for flat knitting machine as set forth in claim 6, wherein the point at which said mounting member for sub-presser means is pivotally supported on said support means is positioned substantially on an extension of a virtual line connecting between the upper ends of needle tricks of the two needle beds.

11. A stitch pressing, device for flat knitting machine as set forth in claim 6, wherein said pair of cam grooves, upper and lower, provided on said grooved cam plate has a cam surface for displacing said stitch presser bar downwardly from the direction of slide movement of said upper and lower sliders at a point adjacent their rearwardmost position as said sliders approach said rearwardmost position.

* * * * *

UNITED STATES PATENT AND TRADEMARK OFFICE

CERTIFICATE OF CORRECTION

PATENT NO. : 4,442,683

DATED : April 17, 1984

INVENTOR(S) : Masahiro Shima et al

It is certified that error appears in the above-identified patent and that said Letters Patent is hereby corrected as shown below:

In column 16, line 48 "1" should be --6--.

Signed and Sealed this

*Ninth* Day of *October 1984*

[SEAL]

*Attest:*

GERALD J. MOSSINGHOFF

*Attesting Officer*

*Commissioner of Patents and Trademarks*